United States Patent [19]

Guth et al.

[11] 4,345,909

[45] Aug. 24, 1982

[54] PROCESS FOR DYEING OR TREATING TEXTILE FIBRE MATERIALS

[75] Inventors: Christian Guth, Basel; Hanspeter Gysin, Aesch; Jörg Binz, Reinach, all of Switzerland

[73] Assignee: Ciba-Geigy Corporation, Ardsley, N.Y.

[21] Appl. No.: 261,994

[22] Filed: May 8, 1981

[30] Foreign Application Priority Data

May 19, 1980 [CH] Switzerland ..... 3883/80

[51] Int. Cl.[3] ..... D06P 1/62

[52] U.S. Cl. ..... 8/477; 252/8.6; 252/8.8; 252/8.9

[58] Field of Search ..... 8/477; 252/8.6, 8.8, 252/8.9

[56] References Cited

U.S. PATENT DOCUMENTS

| | | | |
|---|---|---|---|
| 2,971,458 | 2/1961 | Kumins et al. | 8/477 |
| 3,762,860 | 10/1973 | Abrahams et al. | 8/477 |
| 3,990,840 | 11/1976 | von der Eltz et al. | 8/477 |
| 4,099,913 | 7/1978 | Walter et al. | 8/477 |
| 4,118,526 | 10/1978 | Gregorian et al. | 8/477 |
| 4,193,762 | 3/1980 | Namboodri | 8/500 |
| 4,270,915 | 6/1981 | Johnson et al. | 8/477 |

FOREIGN PATENT DOCUMENTS

| | | |
|---|---|---|
| 9240 | 4/1980 | European Pat. Off. . |
| 9241 | 4/1980 | European Pat. Off. . |
| 9721 | 4/1980 | European Pat. Off. . |

*Primary Examiner*—A. Lionel Clingman
*Attorney, Agent, or Firm*—Edward McC. Roberts

[57] ABSTRACT

A process for dyeing or treating textile fibre materials with foam, which process comprises applying to the textile fibre materials a foamed aqueous composition which, in addition to containing the dye (or fluorescent whitening agent) or the fabric finishing agent, contains a foamable system comprising water and (A) a fatty acid/alkanolamine reaction product or an alkylene oxide adduct of this reaction product and at least two of the following components (B) a fatty alcohol which is optionally mono-, di- or triethoxylated and which contains 8 to 22 carbon atoms in the fatty alcohol radical, (C) an adduct of 5 to 15 moles of ethylene oxide and 1 mole of a fatty alcohol or a fatty acid, each containing 8 to 22 carbon atoms, or 1 mole of an alkylphenol containing a total of 1 to 12 carbon atoms in the alkyl moiety, and (D) an acid ester, or a salt thereof, of a polyadduct of 2 to 15 moles of ethylene oxide and 1 mole of a fatty alcohol containing 8 to 22 carbon atoms.

The composition is then applied to the textile fibre materials, which are subsequently subjected to a heat treatment, e.g. by thermofixation, in the temperature range from 120° to 210° C., or by steaming in the range from 100° to 120° C., with or without first drying them.

16 Claims, No Drawings

PROCESS FOR DYEING OR TREATING TEXTILE FIBRE MATERIALS

The present invention relates to a continuous process for dyeing or treating textile fibre materials with foam, and to the dyed or treated textile material obtained by this process.

The process of this invention comprises applying to the textile fibre materials a foamed aqueous composition which, in addition to containing the dye (or fluorescent whitening agent) or the fabric finishing agent, contains a foamable system comprising water and (A) a fatty acid/alkanolamine reaction product or an alkylene oxide adduct of this reaction product and at least two of the following components (B) a fatty alcohol which is optionally mono-, di- or triethoxylated and which contains 8 to 22 carbon atoms in the fatty alcohol radical, (C) an adduct of 5 to 15 moles of ethylene oxide and 1 mole of a fatty alcohol or a fatty acid, each containing 8 to 22 carbon atoms, or 1 mole of an alkylphenol containing a total of 1 to 12 carbon atoms in the alkyl moiety, and (D) an acid ester, or a salt thereof, of a polyadduct of 2 to 15 moles of ethylene oxide and 1 mole of a fatty alcohol containing 8 to 22 carbon atoms, and subsequently subjecting said materials to a heat treatment, with or without first drying them.

In addition to containing the dye or finishing agent and component (A), the composition to be employed in the practice of this invention always contains at least two of components (B), (C) and (D), which components can be present singly or in admixture.

Preferred treatment liquors contain the following components:

(A)+(B)+(C)
(A)+(B)+(C)+(D) or
(A)+(C)+(D).

The fatty acid/alkanolamine reaction products suitable for use as component (A) can be derived from fatty acids containing 10 to 22 carbon atoms and from alkanolamines containing 2 or 3 carbon atoms in each alkanol moiety.

Preferred reaction products are those of fatty acids containing 12 to 18 carbon atoms. Examples of suitable alkanolamine are ethanolamine, diethanolamine, propanolamine, isopropanolamine or diisopropanolamine. Dialkanolamines are preferred, especially diethanolamine. The molar ratio of fatty acid to dialkanolamine can be 1:1 to 1:2. Representative examples of fatty acids are: lauric acid, coconut fatty acid, myristic acid, palmitic acid, tallow fatty acid, oleic acid, ricinolic acid, stearic acid, arachidic acid or behenic acid. It is also possible to use the mixtures of these acids which are obtained by cleaving natural oils or fats. Mixtures of palmitic and stearic acid and, in particular, coconut fatty acid, are most preferred. The reaction products of component (A) and methods of obtaining them are known e.g. from U.S. Pat. No. 2,089,212.

As component (A) it is also possible to use alkylene oxide adducts, especially ethylene oxide adducts, of the above mentioned fatty acid/alkanolamine reaction products, individual ethylene oxide units of which adducts can be replaced by substituted epoxides such as propylene oxide. The number of alkylene oxide groups in these glycol ethers can be 1 to 8 and, preferably, 1 to 4. Preferred adducts are those of 2 to 4 moles of ethylene oxide with 1 mole of the reaction product of 1 mole of coconut fatty acid, stearic acid and/or palmitic acid with 1 mole of diethanolamine.

Most preferably, component (A) is coconut fatty acid diethanolamide. The amounts in which component (A) is added by itself or in admixture to the treatment liquors range from 0.2 g to 5 g per liter of liquor.

Component (B) is an optionally ethoxylated fatty alcohol as defined herein having an HLB value of preferably 0.1 to 10, most preferably 0.5 to 10. Components (B) having HLB values in the range from 0.1 to 7 are especially advantageous (the HLB value stands for the hydrophilic/lipophilic balance in the molecule). The HLB values can be determined or calculated experimentally in accordance with the method of W. C. Griffith, ISCC 5, 249 (1954) or of J. T. Davis, Tenside Detergens 11, (1974), No. 3, p. 133.

The fatty alcohols suitable for use as component (B) can be saturated or unsaturated. They contain preferably 12 to 18 carbon atoms. Examples of such alcohols are: lauryl, myristyl, cetyl, stearyl, oleyl, arachidyl, or behenyl alcohol, or $C_{12}$–$C_{22}$alfols. These fatty alcohols can advantageously be mono-, di- or triethoxylated.

Preferred components (B) are cetyl alcohol or diethylene glycol cetyl ether (=polyoxyethylene-(2)-cetyl ether) of the formula $C_{16}H_{33}$—O—$(CH_2CH_2O)_2$—H.

The amounts in which component (B) is added by itself or in admixture to the treatment liquors range from 0.01 to 2 g per liter of liquor.

Component (C) is advantageously a nonionic adduct of 5 to 15 moles, preferably 7 to 15 moles, of ethylene oxide with 1 mole of an aliphatic monoalcohol containing 8 to 22 carbon atoms or, in particular, of an alkylphenol or phenylphenol.

The aliphatic monoalcohols can be saturated or unsaturated and used individually or in admixture with each other. It is possible to react natural alcohols, e.g. lauryl alcohol, myristyl alcohol, cetyl alcohol, stearyl alcohol, oleyl alcohol, or synthetic alcohols such as, in particular, 2-ethylhexanol, and also trimethylhexanol, trimethylnonyl alcohol, hexadecyl alcohol or the above alfols, with ethylene oxide.

Examples of suitable alkylphenols are those containing 1 to 12, preferably 4 to 12, carbon atoms in the alkyl moiety. Examples of these alkylphenols are p-cresol, butylphenol, tributylphenol, octylphenol and, in particular, nonylphenol.

Polyadducts of 5 to 15 moles of ethylene oxide and 1 mole of fatty acid can also be used as component (C). The fatty acids preferably contain 10 to 20 carbon atoms and can be saturated or unsaturated. Examples are: capric, lauric, myristic, palmitic or stearic acid, and decenoic, dodecenoic, tetradecenoic, hexadecenoic, oleic, linolic, linolenic or preferably ricinolic acid.

The amounts in which component (C) is used alone or in admixture to the treatment liquors range from 0.001 to 0.5 g per liter of treatment liquor.

The anionic fatty alcohol ethylene glycol ethers suitable for use as component (D) are preferably adduct of 2 to 15 moles of ethylene oxide with 1 mole of a fatty alcohol containing 8 to 22 carbon atoms, said adducts containing acid ester groups of inorganic or organic acids.

Preferred components (D) have the formula $$R—O—(CH_2CH_2)—O)_m—X$$

wherein R is alkyl or alkenyl, each of 10 to 18 carbon atoms, X is the acid radical of an inorganic oxygen-containing acid, e.g. orthophosphoric acid or sulfuric acid, and m is 2 to 15, preferably 2 to 10.

The acid radical can be in salt form, e.g. as alkali metal, alkaline earth metal, ammonium or amine salt. Examples of such salts are: lithium, sodium, potassium, calcium, ammonium, trimethylamine, ethanolamine, diethanolamine or triethanolamine salts. Sodium salts and ammonium salts are preferred.

The radical R—O is derived e.g. from the above mentioned aliphatic monoalcohols. The preferred monoalcohol is in this case lauryl alcohol.

The amounts in which component (D) is added singly or in admixture to the treatment liquors range from 0.1 g to 1.0 g per liter of liquor.

Preferred foamable systems comprise at least the following components:

($A_1$) a fatty acid diethanolamide containing 12 to 18 carbon atoms in the fatty acid radical, and at least two of the components ($B_1$) cetyl alcohol or diethoxylated cetyl alcohol, ($C_1$) an adduct of 5 to 15 moles of ethylene oxide with 1 mole of an aliphatic monoalcohol containing 8 to 18 carbon atoms or of an alkylphenol containing 4 to 12 carbon atoms in the alkyl moiety, and ($D_1$) a sulfuric acid ester, or a salt thereof, of a polyadduct of 2 to 10 moles of ethylene oxide with 1 mole of a fatty alcohol containing 10 to 18 carbon atoms.

The foamable systems can be prepared by simply stirring components (A), (B), (C) and/or (D) together with water. If desired, the foamable systems can be added in the form of one or more mixtures to the treatment liquors. The single mixtures can act as foam regulator, foam stabiliser or wetting agent. The weight ratio of component (A) to component (B) is advantageously from about 20:1 to 1:1, preferably 15:1 to 2:1, to component (C) advantageously from 600:1 to 1:3, preferably 100:1 to 1:2, and to component (D) advantageously 3:1 to 1:2, preferably 2:1 to 1:1.

The foamable systems contain altogether with advantage, in each case based on the weight of the entire system:

5 to 60% by weight of component (A)
0 to 10% by weight of component (B)
0.1 to 20% by weight of component (C)
0 to 10% by weight of component (D) and
35 to 80% by weight of water.

The amounts in which the foamable systems are added to the treatment liquors range from 1 to 30 g, preferably from 1.5 to 15 g, per liter of liquor, depending on the method of dyeing or treatment.

The substrates to be treated in the practice of this invention can be made from all natural and/or synthetic fibrous materials, e.g. cotton, hemp, linen, jute, ramie, viscose-silk, viscose rayon, cellulose acetate ($2\frac{1}{2}$- or triacetate), polyester, polyacrylonitrile, polyamide 6 or 66, wool, silk, polypropylene, as well as fibre blends, e.g. blends of polyacrylonitrile/cotton, polyester/viscose, polyester/wool, polyamide/polyester and, in particular, polyester/cotton. Pile fabrics of polyamide, polyacrylonitrile, polyester, wool, cotton or the corresponding fibre blends are preferred.

Depending on the substrate to be dyed, the usual classes of dye are suitable for the dyeing process of this invention, e.g. reactive dyes, substantive dyes, acid dyes, 1:1 or 1:2 metal complex dyes, disperse dyes, pigment dyes, vat dyes, basic dyes or coupling dyes. Mixtures of dyes can also be used in the process of the invention. Examples of dyes are described in the Colour Index, 3rd Edition, 1971, Vol. 4.

The foamable systems can also be used for whitening undyed fibrous materials with fluorescent whitening agents. Depending on the substrate, it is possible to use anionic or cationic as well as water-dispersible fluorescent whitening agents, which can belong to the styryl, stilbene, coumarin, pyrazine, pyrazoline, triazolyl or benzimidazolyl series.

Suitable fabric finishing agents which can be applied in the process of this invention are all chemical finishing agents which are suitable for use in the textile field, such as conditioning agents, binders, fabric softeners, cleansing agents and sizing agents. It is possible to apply e.g. anti-static agents, flame retardants, water repellents, oil repellents, anticrease agents, easy-care agents, stiffeners, antisoil or soil release agents.

The treatment liquors can also contain conventional additional ingredients, preferably electrolytes such as salts, e.g. sodium sulfate, ammonium sulfate, sodium or ammonium phosphates or polyphosphates, ammonium acetate or sodium acetate and/or acids, e.g. mineral acids such as sulfuric acid or phosphoric acid, or organic acids, preferably lower aliphatic carboxylic acids such as formic, acetic or oxalic acid. The acids are employed principally for adjusting the pH value of the liquors to be used in the process of this invention. Depending on the substrate to be treated, the pH is usually in the range from 4 to 8.

Depending on the desired effect, the treatment liquors can contain still further additional ingredients such as catalysts, urea, oxidants, solvents, dispersants, emulsifiers or retardants.

The foams are preferably produced by mechanical means using impellers, mixers or also special foam pumps, with which latter the foams can also be produced continuously. In the practice of this invention, blow ratios, i.e. volume ratios of unfoamed to foamed composition, of 1:6 to 1:20, preferably 1:8 to 1:15, have proved suitable.

The foams employed in the process of the invention have the property of being thick, dense and stable, i.e. they can be kept and used over a prolonged period of time. The foams preferably have half-lives of 5 to 30 minutes. The bubbles in the foams have diameters from about 1 to 100$\mu$.

The foams can be applied uniformly to the fibrous materials by a wide variety of techniques. Examples of some application methods are: vacuum penetration, rolling on, rolling on/suction, doctor coating with fixed blades or roll coating (on one side or both sides), padding, blowing in, compressing, passing the textile substrate through a chamber which is continuously charged with foam and in which the foam is under a certain pressure. These procedures cause the foam structure to collapse, i.e. the foam decomposes and wets the textile material.

The application of the foam is usually made at room temperature i.e. in the range from about 15° to 30° C. The add-on of foam is normally 10 to 60, in particular 12 to 50% by weight, based on the treated fabric.

For dyeing or treating textiles, a treatment liquor is foamed and the foam is applied from a foam container, preferably with an adjustable doctor blade, via a roller to the face of the fabric. When the foam comes in contact with the fabric it collapses immediately. If desired, the foam can also be applied to the back of the fabric, in which case it is not necessary to dry the fabric first before the second application. It is also possible to apply different treatment liquors to the face and back of the textile fabric.

The substrates do not need to be pretreated for the foam application, but they can also be prewetted at room temperature or prewashed in the temperature range up to 80° C. or texturised.

After the foam add-on and the collapse of the foam, the substrate is subjected to a heat treatment, e.g. in the temperature range from 50°, preferably 100° to 210° C. It is preferred to carry out the heat treatment after drying the substrate beforehand in the range from 80° to 190° C., preferably 120° C., by thermofixing (dry heat) in the temperature range from 120° to 210° C., preferably from 140° to 180° C. The heat treatment can also be carried out direct, i.e. without drying the fabric beforehand, either with dry heat in the temperature range from 120° to 210° C. or by steaming in the range from 100° to 120° C. Depending on the heat development and the temperature range, the heat treatment can take from 30 seconds to 10 minutes. If desired or necessary, the dyes or finishing agents can also be fixed by a chemical bath or a metal bath.

Following the heat treatment the textile material can be given a washing-off in conventional manner in order to remove non-fixed dye or non-fixed finishing agents. This is accomplished by treating the substrate e.g. at 40°-80° C. in a solution which contains soap or synthetic detergent.

Level dyeings having good wet- and lightfastness or fibrous materials having a good finish are obtained by the process of the invention using foam. In foam dyeing a relatively small amount of moisture is applied in comparison with the conventional continuous methods in which the amount of treatment liquor is up to 500%, based on the substrate, so that a shorter heat treatment and thus a higher productivity rate is possible. In finishing, an improvement in the ratio of obtainable effect (e.g. in resin finishing) to loss in tensile strength is observed in comparison to conventional pad applications. In addition, the wastewater in dyehouses and finishing plants is polluted to only an insignificant degree owing to the small amounts of liquid involved, so that the process of the invention is advantageous from the environmental point of view. The saving in water and energy is also an advantageous consequence of the process of the invention.

In the following Examples percentages are by weight, unless otherwise indicated. The amounts of dye relate to commercially available, i.e. diluted, product and the amounts of components (A) to (D) relate to pure substance.

The following reaction products are examples of components (C) and (D):

NONIONIC COMPONENTS (C)

$C_1$ the reaction product of 6 moles of ethylene oxide and 1 mole of 2-ethyl-hexanol;

$C_2$ the reaction product of 5 moles of ethylene oxide and 1 mole of 2-ethylhexanol;

$C_3$ the reaction product of 15 moles of ethylene oxide and 1 mole of stearyl alcohol;

$C_4$ the reaction product of 9 moles of ethylene oxide and 1 mole of alfol (1014);

$R_5$ the reaction product of 5 moles of ethylene oxide and 1 mole of hexadecyl alcohol;

$C_6$ the reaction product of 15 moles of ethylene oxide and 1 mole of cetyl alcohol;

$C_7$ the reaction product of 6 moles of ethylene oxide and 2 moles of butylphenol;

$C_8$ the reaction product of 6 moles of ethylene oxide and 2 moles of p-cresol;

$C_9$ the reaction product of 6 moles of ethylene oxide and 1 mole of tributylphenol;

$C_{10}$ the reaction product of 6 moles of ethylene oxide and 1 mole of octylphenol;

$C_{11}$ the reaction product of 9 moles of ethylene oxide and 1 mole of nonylphenol;

$C_{12}$ the reaction product of 6 moles of ethylene oxide and 1 mole of nonylphenol;

$C_{13}$ the reaction product of 8 moles of ethylene oxide and 1 mole of nonylphenol;

$C_{14}$ the reaction product of 15 moles of ethylene oxide and 1 mole of oleyl alcohol;

$C_{15}$ the reaction product of 12 moles of ethylene oxide and 1 mole of oleic acid;

$C_{16}$ the reaction product of 8 moles of ethylene oxide and 1 mole of o-phenylphenol.

ANIONIC COMPONENTS (D)

$D_1$ the ammonium salt of the acid sulfuric acid ester of the adduct of 2 moles of ethylene oxide and 1 mole of alfol (1014);

$D_2$ the ammonium salt of the acid sulfuric acid ester of the adduct of 2 moles of ethylene oxide and 1 mole of stearyl alcohol;

$D_3$ the ammonium salt of the acid sulfuric acid ester of the adduct of 3 moles of ethylene oxide and 1 mole of 2-ethyl-hexanol;

$D_4$ the ammonium salt of the acid sulfuric acid ester of the adduct of 15 moles of ethylene oxide and 1 mole of stearyl alcohol;

$D_5$ the ammonium salt of the acid sulfuric acid ester of the adduct of 3 moles of ethylene oxide and 1 mole of tridecyl alcohol;

$D_6$ the ammonium salt of the acid sulfuric acid ester of the adduct of 4 moles of ethylene oxide and 1 mole of hydroabietyl alcohol;

$D_7$ the ammonium salt of the acid sulfuric acid ester of the adduct of 3 moles of ethylene oxide and 1 mole of alfol (2022);

$D_8$ the ammonium salt of the acid sulfuric acid ester of the adduct of 3 moles of ethylene oxide and 1 mole of lauryl alcohol;

$D_9$ the di-($\beta$-hydroxyethyl)amine salt of the acid sulfuric acid ester of the adduct of 3 moles of ethylene oxide and 1 mole of lauryl alcohol;

$D_{10}$ the sodium salt of the acid sulfuric acid ester of the adduct in 2 moles of ethylene oxide and 1 mole of lauryl alcohol;

$D_{11}$ the sodium salt of the acid sulfuric acid ester of the adduct of 3 moles of ethylene oxide and 1 mole of lauryl alcohol;

$D_{12}$ the acid phosphoric acid ester of the adduct of 5 moles of ethylene oxide and 1 mole of 2-ethyl-hexanol;

$D_{13}$ the sodium salt of the phosphoric acid ester of the adduct of 5 moles of ethylene oxide and 1 mole of octanol.

EXAMPLE 1

A foam having a blow ratio of 1:14 is prepared in a foaming apparatus from a liquor of the following composition:

100 g/l of a dimethylolurea resin
75 g/l of a stearic acid/diethanolamine reaction product (15%)
6 g/l of magnesium chloride hexahydrate
1.5 g/l of a mixture consisting of
9.5% of coconut fatty acid diethanolamide
11.5% of component $C_{11}$
7.5% of component $D_8$
71.5% of water
and acetic acid for adjusting the liquor to pH 6. The foam has a half-life of 15 minutes.

This foam is applied from a foam container (with blade for adjusting the layer of foam) via an applicator roll to the face of a cotton/polyester corduroy material (50:50) having a weight of 324 g/m². The thickness of the layer of foam on the roll is 0.8 mm. The add-on of foam on the fabric is 17%, based on the weight of the fabric. The same add-on of foam is applied to the back of the corduroy, resulting in a total add-on of 34%. The corduroy is then dried and subjected to a dry heat treatment for 3 minutes at 160° C. A crush-resistant and dimensionally stable soft pile finish is obtained.

EXAMPLE 2

The following dye liquor is foamed in the same manner as described in Example 1:

40 g/l of a dye of the formula (101)

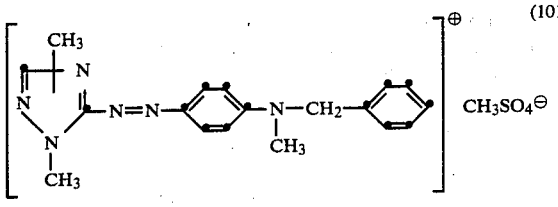

and 3 g/l of a mixture consisting of
53.0% of coconut fatty acid diethanolamide
0.2% of component $C_3$
0.1% of component $C_{15}$
3.3% of cetyl alcohol and
43.4% of water.

The blow ratio is 1:13 and the foam has a half-life of 17 minutes.

This foam is applied to the face of a polyacrylonitrile fabric having a weight of 185 g/m². The layer of foam on the applicator roll has a thickness of 0.4 mm. The add-on of foam on the fabric is 17%, based on the weight of the fabric. A similar add-on of foam is made to the back of the fabric, resulting in a total add-on of 34%. Without first being dried, the fabric is then steamed for 15 minutes at 100° C. with saturated steam and subsequently rinsed and dried. A red dyeing of excellent light- and wetfastness is obtained.

EXAMPLE 3

A dye liquor of the following composition is foamed in the same manner as described in Example 1:

30 g/l of a dye of the formula (102)

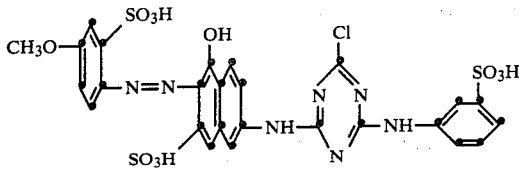

50 g/l of urea
20 g/l of sodium bicarbonate
10 g/l of a mixture consisting of
45.0% of coconut fatty acid diethanolamide
0.16% of component $C_3$
0.08% of component $C_{15}$
2.3% of polyoxyethylene-(2)-cetyl ether
2.46% of cetyl alcohol and
50% of water.

The blow ratio is 1:12 and the foam has a half-life of 22 minutes.

This foam is applied to the face of a viscose-flocked cotton fabric (350 g/m²). The layer of foam has a thickness of 1.1 mm and the add-on of foam on the fabric is 25%. The fabric is then steamed for 3 minutes at 100° C. with saturated steam and subsequently rinsed, soaped and dried. The fabric is dyed on one side in a yellow shade of great brilliance and excellent fastness properties.

EXAMPLE 4

A dye liquor of the following composition is foamed in the same manner as described in Example 1:

40 g/l of a 1:1 mixture of the dyes of the formulae (103)

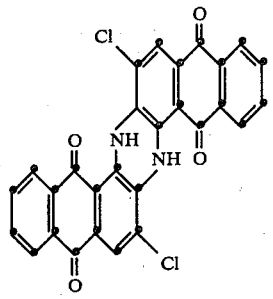

and (104)

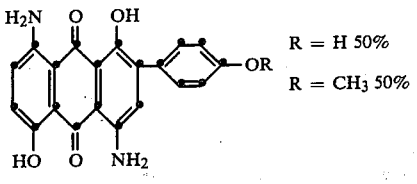

4 g/l of a mixture consisting of
8% of coconut fatty acid diethanolamide
8.8% of component $C_{11}$
5.4% of component $D_8$
3% of polyoxyethylene-(2)-cetyl ether
74.8% of water
and acetic acid for adjusting the pH of the liquor to 5.5.

Half-life of the foam 12 minutes.

This foam is applied to the face of a cotton/polyester gabardine fabric (33:67; 207 g/m²). The layer of foam on the applicator roll has a thickness of 0.45 mm. The add-on of foam on the fabric is 15%, based on the weight of the fabric. The same application of foam is then made to the back of the fabric, giving a total add-on of 30%. The dyeing is then fixed by drying the fabric and subjecting it to a dry heat treatment at 200° C. for 1 minute. The fabric is then put into a chemical bath containing 80 ml/l of sodium hydroxide solution (36° Bé) and 60 g/l of sodium hydrosulfite, squeezed out to a pick-up of 70% and steamed for 60 seconds at 102° C. with saturated steam. The fabric is then rinsed, soaped and dried. A level blue dyeing of good general use fastness properties is obtained.

EXAMPLE 5

A dye liquor of the following composition is foamed in the same manner as described in Example 1:

15 g/l of a dye of the formula

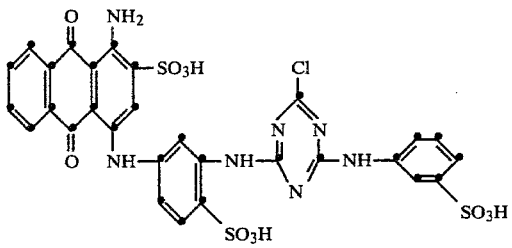

(105)

100 g/l of urea
20 g/l of anhydrous sodium carbonate
15 g/l of a mixture consisting of
36% of coconut fatty acid diethanolamide
0.13% of component $C_3$
0.07% of component $C_{15}$
4% of polyoxyethylene-(2)-cetyl ether
2.1% of cetyl alcohol and
57.7% of water.

The blow ratio is 1:15 and the foam has a half-life of 19 minutes.

This foam is applied to the face of a cotton/cretonne fabric (200 g/m$^2$). The thickness of the layer of foam on the applicator roll is 0.65 mm and the add-on of foam on the fabric is 22%, based on the weight of the fabric. The same application of foam is then made to the back of the fabric, giving a total add-on of 44%. The fabric is then dried and subjected to a dry heat treatment for 3 minutes at 150° C. The dyed fabric is then rinsed, soaped and dried. A level blue dyeing of good general use fastness properties is obtained.

EXAMPLE 6

A dye liquor of the following composition is foamed in the same manner as described in Example 1:

20 g/l of a brown dye of the formula

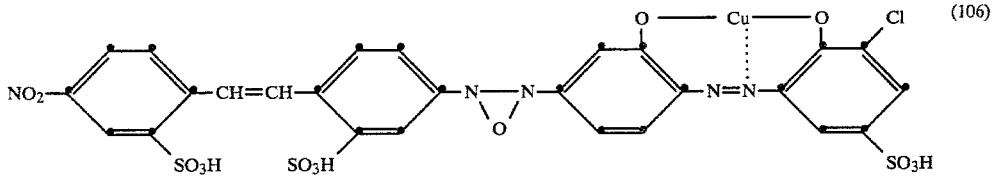

(106)

3 g/l of a mixture consisting of
9.5% of coconut fatty acid diethanolamide
11.5% of component $C_{11}$
7.2% of component $D_8$
71.8% of water and acetic acid for adjusting the pH of the liquor to 6.5. The blow ratio is 1:14 and the foam has a half-life of 12 minutes.

This foam is applied to the cotton back of a cotton/-polyester fabric (180 g/m$^2$). The layer of foam on the applicator roll has a thickness of 1.4 mm and the add-on of foam on the cotton side of the fabric is 55%.

A second dye liquor of the following composition is then foamed for the polyester side (pile side) of the fabric:

6 g/l of a yellow dye of the formula

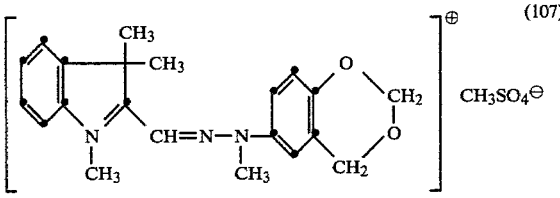

(107)

6 g/l of a red dye of the formula (101)
6 g/l of a blue dye of the formula

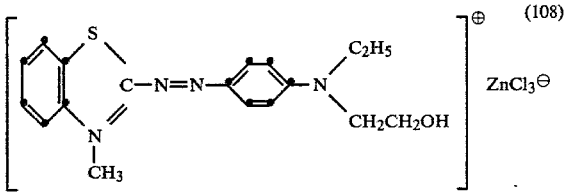

(108)

3 g/l of a mixture consisting of
53.2% of coconut fatty acid diethanolamide
0.2% of component $C_3$
0.1% of component $C_{15}$
3.3% of cetyl alcohol and
42.2% of water.

The blow ratio is 1:10 and the foam has a half-life of 18 minutes.

This second foam is applied to the pile side (face) of the blend. The thickness of the layer of foam on the applicator roll is 0.75 mm. The add-on of foam on the pile side of the fabric is 40%. The fabric is then steamed for 12 minutes at 100° C. with saturated steam, then rinsed and dried. A dark brown dyeing of good fastness properties is obtained.

EXAMPLE 7

A treatment liquor of the following composition is foamed in the same manner as described in Example 1:

160 g/l of an aqueous 80% solution containing dimethyloldihydroxyethylene urea and pentamethylolmelamine tetramethyl ether
50 g/l of magnesium chloride hexahydrate
60 g/l of a 40% polyethylene emulsion 30 g/l of a reaction product of
2% of polyoxyethylene-(2)-cetyl ether
6.4% of coconut fatty acid diethanolamide
5.8% of component $C_{11}$
3.6% of component $D_8$
78.2% of water and acetic acid for adjusting the pH of the liquor to 6. The blow ratio is 1:15 and the foam has a half-life of 20 minutes. This foam is applied to the face of a cotton/poplin fabric (110 g/m$^2$). The thickness of the layer of foam on the applicator roll is 0.35 mm. The add-on of foam on the fabric is 21%, based on the weight of the fabric. The same application of foam is then made to the back of the fabric, giving a total add-on of 42%. The fabric is then dried and subjected to a dry heat treatment for 5 minutes at 150° C. The resultant wash-and-wear finish has excellent crease resistance.

EXAMPLE 8

A treatment liquor of the following composition is foamed in the same manner as described in Example 1:

150 g/l of a 50% aqueous polyacrylate emulsion
30 g/l of a 40% polyethylene emulsion
15 g/l of a mixture consisting of
7.4% of coconut fatty acid diethanolamide
7.8% of component $C_{11}$
4.8% of component $D_8$
4.0% of polyoxyethylene-(2)-cetyl ether
76.0% of water and acetic acid for adjusting the pH of the liquor to 6. The blow ratio is 1:15 and the foam has a half-life of 15 minutes. This foam is applied to the back of a cotton/-polyester pile fabric (450 g/m$^2$). The thickness of the layer of foam on the applicator roll is 0.8 mm. The add-on of foam on the fabric is 12%, based on the weight of the fabric. The fabric is then dried and subjected to a dry heat treatment for 3 minutes at 160° C. Good strengthening of the pile is effected by means of this finish.

EXAMPLE 9

A treatment liquor of the following composition is foamed in the same manner as described in Example 1:

70 g/l of a 50% aqueous polyvinyl acetate dispersion
60 g/l of a 15% stearic acid/diethanolamine reaction product
10 g/l of a mixture of
9.7% of coconut fatty acid diethanolamide
11.7% of component $C_{11}$
7.2% of component $D_8$
71.4% of water and acetic acid for adjusting the pH of the liquor to 6.5. The blow ratio is 1:16 and the foam has a half-life of 26 minutes.

This foam is applied to the face of a printed cotton fabric (100 g/m$^2$). The thickness of the layer of foam on the applicator roll is 0.55 mm. The add-on of foam on the fabric is 33%, based on the weight of the fabric. The fabric is then dried. A soft, full handle is obtained on the fabric.

EXAMPLE 10

The following aqueous composition is foamed in a foaming apparatus:

100 g/l of a dimethyloldihydroxyethylene urea resin
40 g/l of a 15% stearic acid/diethanolamine reaction product
25 g/l of magnesium chloride hexahydrate
3 g/l of a mixture consisting of
10% of palmitic acid diethanolamide
12% of a mixture of components $C_6$ and $C_{14}$
7% of component $D_{13}$
71% of water and acetic acid for adjusting the pH of the liquor to 6. The blow ratio is 1:13 and the foam has a half-life of 18 minutes.

This foam is applied to the face of a cotton fabric (215 g/m$^2$) as described in Example 1. The thickness of the layer of foam on the applicator roll is 0.5 mm. The add-on of foam on the fabric is 18%, based on the weight of the fabric. The same application of foam is then made to the back of the fabric, giving a total add-on of 36%. The fabric is then dried and subjected to a dry heat treatment for 4 minutes at 155° C. A fabric having good wash-and-wear properties is obtained.

EXAMPLE 11

A treatment liquor of the following composition is foamed in the same manner as described in Example 1:

140 g/l of a 50% aqueous polyacrylate emulsion
20 g/l of a 40% polyethylene emulsion
15 g/l of a mixture consisting of
3.1% of stearic acid diethanolamide
3.8% of a mixture of components $C_6$ and $C_{14}$
2.5% of component $D_{13}$
1.3% of coconut fatty acid diethanolamide
82.1% of water and acetic acid for adjusting the pH of the liquor to 6. The blow ratio is 1:16 and the foam has a half-life of 14 minutes.

This foam is applied to the back of a cotton/polyester fabric (380 g/m$^2$). The thickness of the layer of foam on the applicator roll is 0.7 mm. The add-on of foam on the fabric is 14%, based on the weight of the fabric. The fabric is then dried and subjected to a dry heat treatment for 2 minutes at 170° C. A good strengthening of the pile is obtained with this finish.

EXAMPLE 12

The following composition is foamed in the same manner as described in Example 1:

80 g/l of a 15% stearic acid/diethanolamine reaction product
2 g/l of a mixture consisting of
8.5% of palmitic acid diethanolamide
11% of component $C_3$
7.5% of component $D_{11}$ and acetic acid for adjusting the pH of the liquor to 6. The blow ratio is 1:12 and the foam has a half-life of 18 minutes.

This foam is applied to the face of a cotton fabric (185 g/m$^2$) as described in Example 1. The thickness of the layer of foam on the applicator roll is 0.6 mm. The add-on of foam on the fabric is 25%, based on the weight of the fabric. The goods are then dried at 80° C. A pleasing, soft handle is obtained.

EXAMPLE 13

A foam of the following composition is prepared in a foaming apparatus:

130 g/l of an aqueous 80% solution containing dimethyloldihydroxyethylene urea and pentamethylolmelamine tetramethyl ether 50 g/l of a 20% stearic acid/diethanolamine reaction product
3 g/l of a mixture consisting of
9.5% of coconut fatty acid diethanolamide
11.5% of component $C_{11}$
7.5% of component $D_8$ and
71.5% of water
15 g/l of a stilbenedisulfonic acid derivative
39 g/l of magnesium chloride hexahydrate
and acetic acid for adjusting the pH of the liquor to 6. The blow ratio is 1:9 and the foam has a half-life of 9 minutes. This foam is applied to the face of a centrifuged cotton fabric (126 g/m$^2$) with a residual moisture content of 49%. The thickness of the layer of foam on the applicator roll is 0.3 mm. The add-on of foam on the fabric is 21%, i.e. the ultimate moisture content is 70% (49% initial moisture content and 21% add-on of foam). The fabric is dried at 110°–130° C. and subjected to a dry heat treatment for 4 minutes at 150° C.

A level finish is obtained. The degree of whiteness, based on the reflectance/emission measurement, is 202 WE Ciba-Geigy on the face and 200 WE Ciba-Geigy on the back of the fabric. The evaluation of the degree of whiteness is made in accordance with Ciba-Geigy brochure "Physikalische Grundlagen der Weissgradsteigerung" (1976 edition) using the new Ciba-Geigy plastics scale.

What is claimed is:

1. A process for treating textile fibers with foam, comprising the step of applying to the textile fibers a foamed aqueous composition which contains dye, a fluorescent whitening agent or a fabric finishing agent, and additionally contains water and (A) a fatty acid/alkanolamine reaction product or an alkylene oxide adduct of this reaction product and at least two of the following components (B) a fatty alcohol which is optionally mono-, di- or triethoxylated and which contains 8 to 22 carbon atoms in the fatty alcohol radical, (C) an adduct of 5 to 15 moles of ethylene oxide and 1 mole of a fatty alcohol or a fatty acid, each containing 8 to 22 carbon atoms, or 1 mole of an alkylphenol containing a total of 1 to 12 carbon atoms in the alkyl moiety, and (D) an acid ester, or a salt thereof, of a polyadduct of 2 to 15 moles of ethylene oxide and 1 mole of a fatty alcohol containing 8 to 22 carbon atoms.

2. A process according to claim 1, wherein component (A) is a reaction product of a fatty acid containing 12 to 18 carbon atoms with a dialkanolamine containing 2 or 3 carbon atoms in each alkanol moiety.

3. A process according to claim 1, wherein component (A) is coconut fatty acid diethanolamide.

4. A process according to claim 1, wherein component (B) is cetyl alcohol or diethylene glycol cetyl ether.

5. A process according to claim 1, wherein component (C) is an adduct of 7 to 15 moles of ethylene oxide with 1 mole of an aliphatic monoalcohol containing 8 to 22 carbon atoms or of an alkylphenol containing 4 to 12 carbon atoms in the alkyl moiety.

6. A process according to claim 1, wherein component (D) is an acid ester of the formula $$R—O—(CH_2CH_2—O)_m—X$$

wherein R is alkyl or alkenyl, each of 10 to 18 carbon atoms, X is the acid radical of an inorganic oxygen-containing acid, and m is 2 to 15.

7. A process according to claim 1, wherein the composition contains (A) a fatty acid diethanolamide containing 12 to 18 carbon atoms in the fatty acid radical, and at least two of the components (B) cetyl alcohol or diethoxylated cetyl alcohol, (C) an adduct of 5 to 15 moles of ethylene oxide with 1 mole of an aliphatic monoalcohol containing 8 to 18 carbon atoms or of an alkylphenol containing 4 to 12 carbon atoms in the alkyl moiety, and (D) a sulfuric acid ester, or a salt thereof, of a polyadduct of 2 to 10 moles of ethylene oxide with 1 mole of a fatty alcohol containing 10 to 18 carbon atoms.

8. A process according to claim 1, wherein the composition contains 5 to 60% by weight of component (A)
0 to 10% by weight of component (B)
0.1 to 20% by weight of component (C)
0 to 10% by weight of component (D) and
35 to 80% of water, based on the entire mixture.

9. A process according to claim 1, wherein the foamed composition has a foam half-life of 5 to 30 minutes.

10. A process according to claim 1, which comprises applying the foamed composition continuously to the textile fibers and, after the foam has collapsed, subjecting said fibers to a heat treatment with or without drying the fibers beforehand.

11. A process according to claim 1, wherein the foamed composition is applied in succession to both sides of a textile.

12. A process according to claim 1, which further comprises subjecting the fibers to a heat treatment either after first drying the fibers in the temperature range from 80° to 120° C. or without drying the fibers.

13. A process according to claim 1, wherein the fibers are subjected to a heat treatment by thermofixation in the temperature range from 120° to 210° C.

14. A process according to claim 1, which comprises subjecting the fibers to a heat treatment by steaming in the temperature range from 100° to 120° C.

15. A foamed aqueous composition which comprises at least one dye, fluorescent whitening agent or fabric finishing agent, water and (A) a fatty acid/alkanolamine reaction product or an alkylene oxide adduct of this reaction product, and at least two of the following components (B) a fatty alcohol which is optionally mono-, di- or triethoxylated and which contains 8 to 22 carbon atoms in the fatty alcohol radical, (C) an adduct of 5 to 15 moles of ethylene oxide with 1 mole of a fatty alcohol or fatty acid, each containing 8 to 22 carbon atoms, or with 1 mole of an alkylphenol containing a total of 1 to 12 carbon atoms in the alkyl moiety, and (D) an acid ester, or a salt thereof, of a polyadduct of 2 to 15 moles of ethylene oxide with 1 mole of a fatty alcohol containing 8 to 22 carbon atoms.

16. An aqueous foamable composition, comprising water and (A) a fatty acid/alkanolamine reaction product or an alkylene oxide adduct of this reaction product, and at least two of the following components (B) a fatty alcohol which is optionally mono-, di- or triethoxylated and which contains 8 to 22 carbon atoms in the fatty alcohol radical, (C) an adduct of 5 to 15 moles of ethylene oxide with 1 mole of a fatty alcohol or fatty acid, each containing 8 to 22 carbon atoms, or with 1 mole of an alkylphenol containing a total of 1 to 12 carbon atoms in the alkyl moiety, and (D) an acid ester, or a salt thereof, of a polyadduct of 2 to 15 moles of ethylene oxide with 1 mole of a fatty alcohol containing 8 to 22 carbon atoms.

* * * * *